United States Patent [19]

Yanobu et al.

[11] 4,346,551

[45] Aug. 31, 1982

[54] METHOD AND APPARATUS FOR TWISTING AND WINDING YARNS ON PACKAGES

[75] Inventors: Hideo Yanobu, Kyotoshi; Tadashi Tanaka, Ohtsushi, both of Japan

[73] Assignee: Murata Kikai Kabushiki Kaisha, Japan

[21] Appl. No.: 172,384

[22] Filed: Jul. 25, 1980

[30] Foreign Application Priority Data

Jul. 27, 1979 [JP] Japan ..... 54-96430

[51] Int. Cl.[3] ..... D01H 1/10; D01H 13/10

[52] U.S. Cl. ..... 57/62; 57/58.49; 57/58.7; 242/45; 242/155 R

[58] Field of Search ..... 57/58.49, 58.7, 58.83, 57/58.86, 59, 62; 242/45, 155 R

[56] References Cited

U.S. PATENT DOCUMENTS

| | | | |
|---|---|---|---|
| 2,656,126 | 10/1953 | Kingsbury et al. | 242/155 R X |
| 3,616,635 | 11/1971 | Peterson | 57/62 X |
| 4,058,245 | 11/1977 | Hurt et al. | 242/155 R X |
| 4,091,604 | 5/1978 | Grieve | 57/62 X |
| 4,168,605 | 9/1979 | D'Agnolo | 57/58.7 X |

*Primary Examiner*—Donald Watkins

*Attorney, Agent, or Firm*—Whittemore, Hulbert & Belknap

[57] ABSTRACT

A method and apparatus for obtaining packages for dying by twisting and winding processed yarns by a double twister. Between a double twisting spindle and a take-up roller disposed above, there are arranged a winding angle-adjusting device, a feed roller and a traverse device, recited from the side of the spindle. The high yarn tension on the side of the double twister is reduced by using the feed roller having a special structure to obtain a soft wound package.

6 Claims, 19 Drawing Figures

FIG. 4
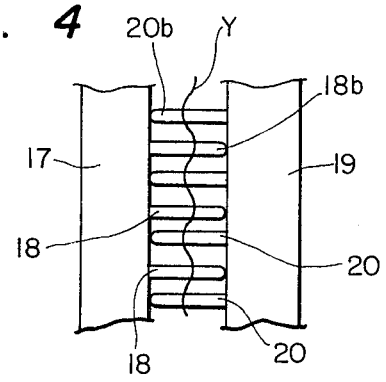
FIG. 5-a
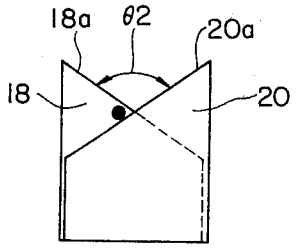
FIG. 5-b
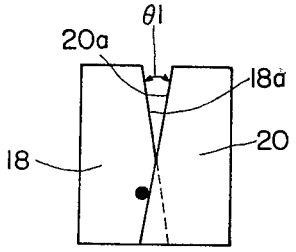
FIG. 6-a
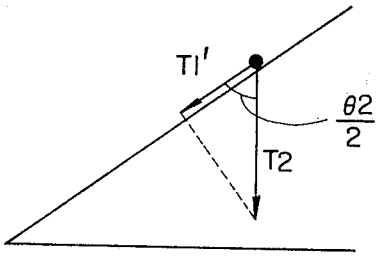
FIG. 6-b
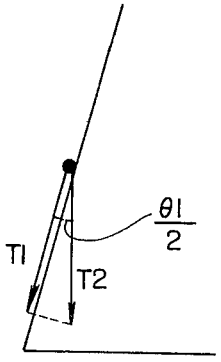

FIG. 8-c
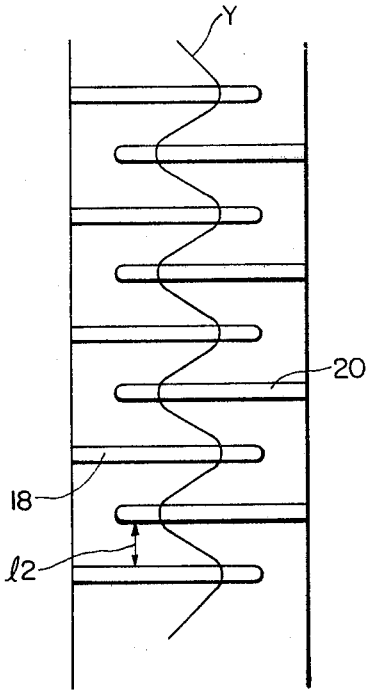
FIG. 8-b
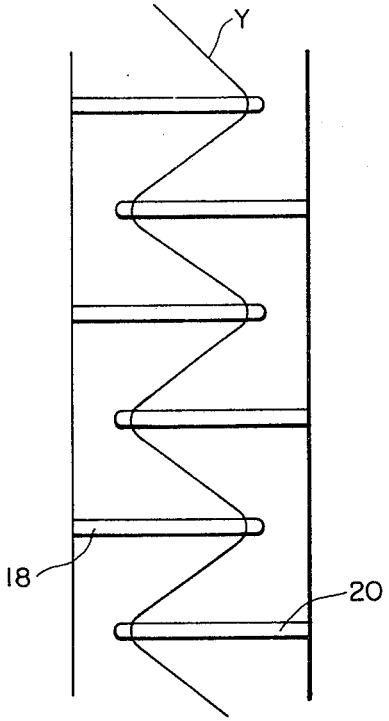
FIG. 8-a
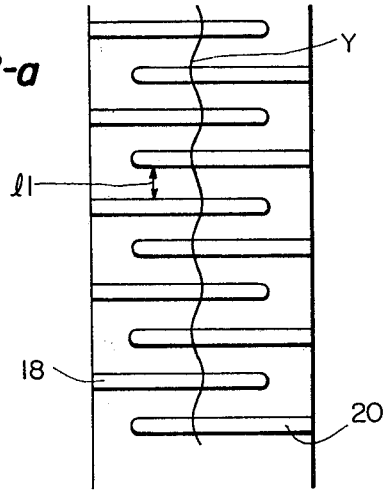

METHOD AND APPARATUS FOR TWISTING AND WINDING YARNS ON PACKAGES

BACKGROUND OF THE INVENTION

In a conventional double twister, a yarn coming from a double twisting spindle ordinarily has a high tension increased by ballooning. Accordingly, a feed roller is arranged between the double twisting spindle and a take-up roller to overfeed the yarn and reduce the yarn tension, and the yarn having a reduced tension is passed through a traverse device and wound on a rotating package by the take-up roller. In forming wound packages by such double twister, especially in case of processed yarns, the tension given by ballooning is not sufficiently reduced by the feed roller and the winding operation is influenced by the yarn tension, with the result that only a hard wound package is obtained. Accordingly, the wound package is unwound and rewound by using a different device in order to form a soft wound package, and the resulting soft wound package is fed to the subsequent dyeing process. Processed yarns of chemical or synthetic fibers tend to elongate even under a small tensile force. For example, when two clerical clips (about 0.6 g) are hung down from the lower end of a processed yarn of the unit length held in the vertical state, the processed yarn elongates and the length is about 1.5 to about 2 times the original length. This is confirmed by a simple experiment. Since processed yarns have such elongation characteristics, a soft wound package cannot be obtained unless the yarn tension on winding is less than 1 g and close to zero.

A high tension is imposed by ballooning on a yarn coming from a double twisting spindle, and it is very difficult to sufficiently reduce this high tension by the above-mentioned conventional feed roller. Even if the angle of winding of the yarn to the feed roller is adjusted, it is impossible to reduce the tension below 1 g. Therefore, according to the conventional technique, it is impossible to obtain a soft wound package in a double twister.

SUMMARY OF THE INVENTION

The present invention relates to a method and apparatus for twisting and winding yarns. More particularly, the present invention relates to a method and apparatus for winding processed yarns twisted by a double twister to form soft packages.

An object of the present invention is to provide a method and apparatus for obtaining soft wound packages for dyeing directly in the double twister.

Another object of the present invention is to provide a feed roller which can reduce the yarn tension on the side of the double twister.

Still another object of the present invention is to provide a feed roller having a special structure for reducing the tension of the processed yarns.

Further objects will be apparent from the following description of the present invention.

BRIEF DESCRIPTION OF THE DRAWINGS

FIG. 4 is a plan view of the feed roller shown in FIG. 3.

FIGS. 5*a* and 5*b* are diagrams illustrating the intersecting angle ($\theta$) between confronting pieces of the feed roller.

FIGS. 6*a* and 6*b* are diagrams illustrating the force of intrusion of the yarn into the pieces.

FIGS. 8*a*, 8*b* and 8*c* are diagrams illustrating influences of the number of the pieces on the meandering distance of the yarn.

DETAILED DESCRIPTION OF THE INVENTION

The present invention will now be described in detail with reference to the accompanying drawings.

Figure 1:
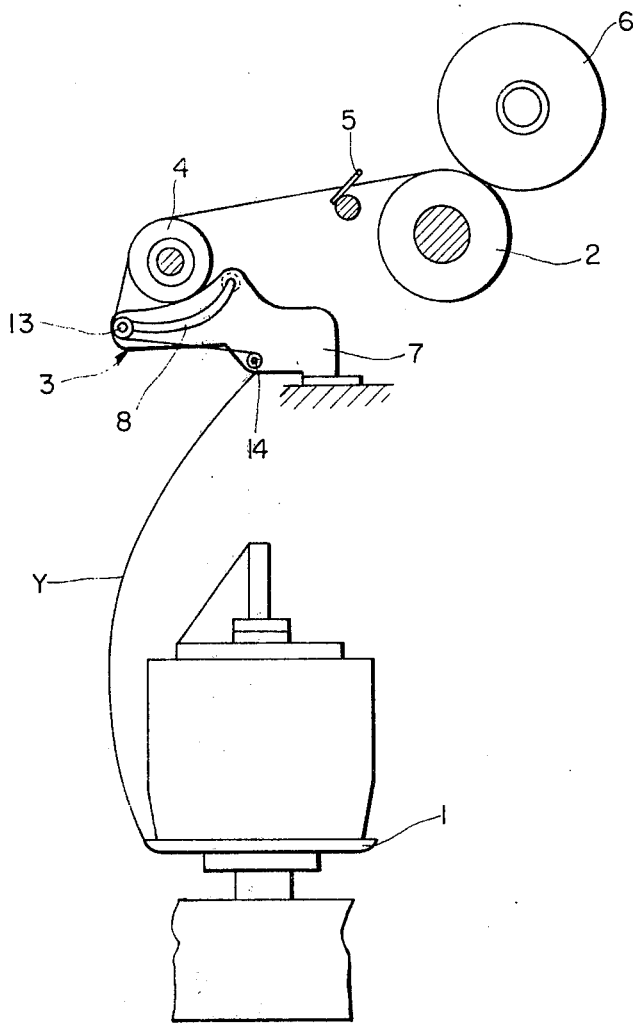
FIG. 1 is a view illustrating diagrammatically the structure of the double twister.
Figure 2:
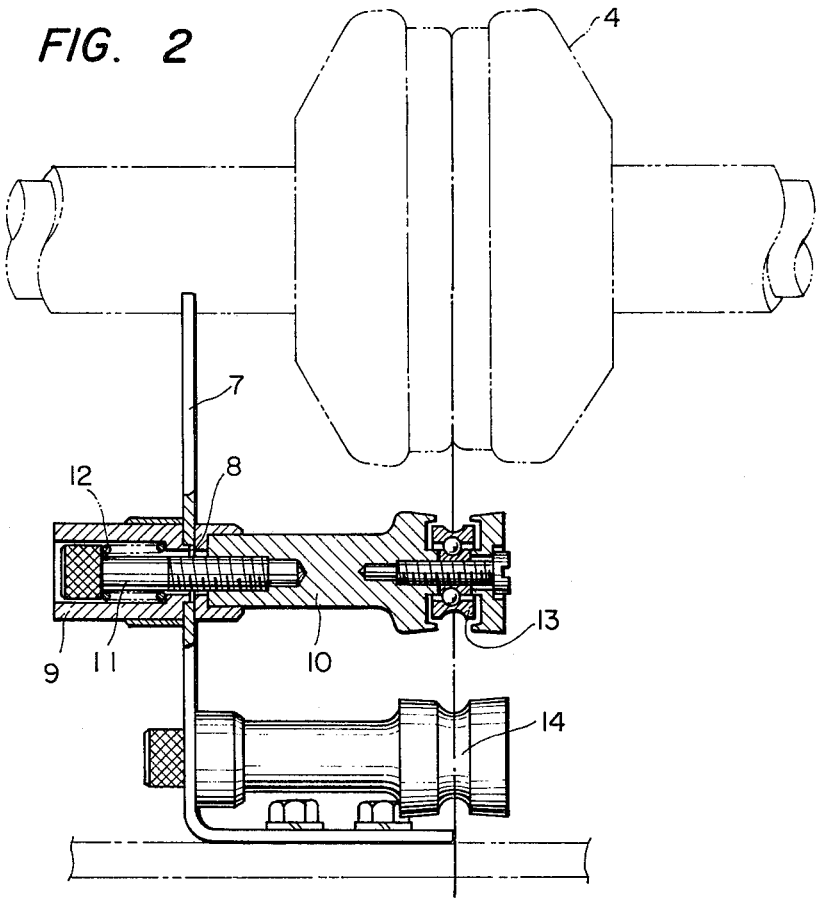
FIG. 2 is a sectional front view showing the winding angle-adjusting device.

Referring to FIGS. 1 and 2 illustrating an apparatus for use in practicing the method of the present invention, between a double twisting spindle 1 and a take-up roller 2 disposed above, there are arranged a winding angle-adjusting device 3, a feed roller 4 and a traverse device 5, recited from the side of the spindle 1. A yarn Y coming from the double twisting spindle 1 is passed through the winding angle-adjusting device 3 and wound on the feed roller 4 at a predetermined winding angle. The tension on the yarn is reduced and the yarn Y is delivered from the feed roller and wound on a package 6 through the traverse device 5 having a guide fixed to a bar moved in the horizontal direction by a known cam mechanism.

The winding angle-adjusting device 3 arranged between the double twisting spindle 1 and the feed roller 4 comprises, as shown in FIGS. 1 and 2, a bracket 7 stationarily set at a position close to the feed roller 4, a long groove 8 formed on the bracket 7, moving cylinder 9 and roller supporting cylinder 10 arranged on both the sides of the long groove 8 to confront each other with the bracket 7 being interposed therebetween, said moving cylinder 9 and roller supporting cylinder 10 being integrally connected to each other by a clamping screw 11 piercing through said long groove 8, and a spring 12 interposed between the moving cylinder 9 and the clamping screw 11 to movably press the moving cylinder 9 and roller supporting cylinder 10 to both the side portions of the bracket 7. Furthermore, a moving roller 13 and a stationary roller 14 are arranged so that they are located just below the yarn passage to the feed roller 4. The yarn travels along one plane through the stationary roller 14, moving roller 13 and feed roller 4. When the moving cylinder 9 is gripped by a hand and moved along the long groove 8 and the moving cylinder 9 is set free at an optional position, the moving cylinder 9 and roller supporting cylinder 10 are pressed to the bracket 7 by the action of the spring 7, and their positions are set and the angle of winding the yarn to the feed roller 4 is thus adjusted.

Figure 3:
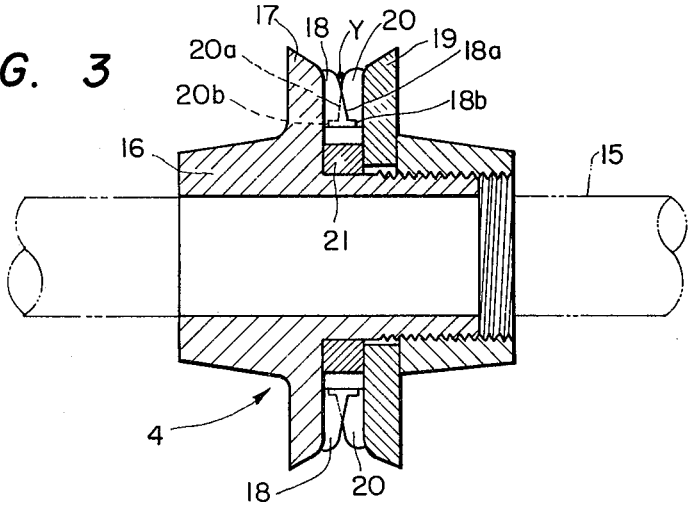
FIG. 3 is a sectional front view showing the feed roller used in practising the method of the present invention.

The structure of the feed roller 4 is shown in FIG. 3. Pieces 18 having an inclined yarn guide face 18*a* are radially projected equidistantly in the circumferential direction on the end face of a disc 17 of a feed roller proper 16 fixed to a driving shaft 15, and pieces 20 similar to the pieces 18, which have a yarn guide face 20*a*, are radially projected equidistantly in the circumferential direction on a disc 19 disposed to confront said disc 17, so that the pieces 18 are engaged with the pieces 20. As shown in FIG. 4, the yarn Y meanders in a zigzag manner and is guided between the guide faces 18*a* and 20*a* of the pieces 18 and 20 by rotation of the discs 17 and 19. Thus, the yarn Y is positively fed out. Referring to FIG. 3, yarn stopping projections 18*b* and 20*b* are formed in the lower portions of the pieces 18 and 20 to prevent falling of the yarn relatively to the intersecting angle ($\theta$) between the pieces, which will be described in detail hereinafter. Pins may be planted instead of these projections. A spacer 21 is inserted between the discs 17 and 19 to adjust the distance between the pieces 18 and 20.

In the present invention, the high yarn tension on the side of the double twister is reduced by using the feed roller 4 having the above-mentioned structure, soft winding of the yarn is realized. As pointed out hereinbefore, a processed yarn tends to elongate even under a very low tension. Therefore, it is very difficult to obtain a soft wound package unless the yarn tension on the winding side is close to zero. In other words, it is necessary to prevent propagation of the high yarn tension given in the double twister on the introduction side of the feed roller and maintain the yarn tension at a level close to zero on the delivery side of the feed roller.

Accordingly, the tension in the feed roller 4 will now be examined. Since the yarn is positively fed out in a zigzag manner along the pieces 18 and 20 of the feed roller 4, the high yarn tension given on the side of the double twisting spindle is gradually reduced during this meandering travel and the yarn tension is low on the delivery side of the feed roller. Accordingly, it is considered that the resistance of the guide faces of the pieces of the feed roller has a great influence on the yarn as a factor for reducing the yarn tension. As main elements changing this resistance, there can be mentioned the number of the pieces, the quantity of intrusion of the yarn between the pieces 18 and 20, i.e., the intersecting angle between the guide faces 18*a* and 20*a* of the pieces, and the slipperiness of the guide faces of the pieces, i.e., the surface roughness of the guide faces of the pieces.

The intersecting angle $\theta$ between the yarn guide faces 18*a* and 20*a* of the pieces 18 and 20 which are projected on the discs 17 and 19 of the feed roller to confront each other will now be described.

Referring to FIGS. 5*a*, 5*b*, 6*a* and 6*b*, if the intersecting angle ($\theta$) is small, the force $T_1$ of slipping down the yarn on the guide face 18*a* or 20*a* by the yarn tension (the force of intruding the yarn into the interior of the piece) is given by the following formula:

$$T_1 = T_2 \cdot \cos(\theta_1/2)$$

and if the intersecting angle $\theta$ is large, said force $T_{1'}$ is given by the following formula:

$$T_{1'} = T_2 \cdot \cos(\theta_2/2)$$

Figure 7:
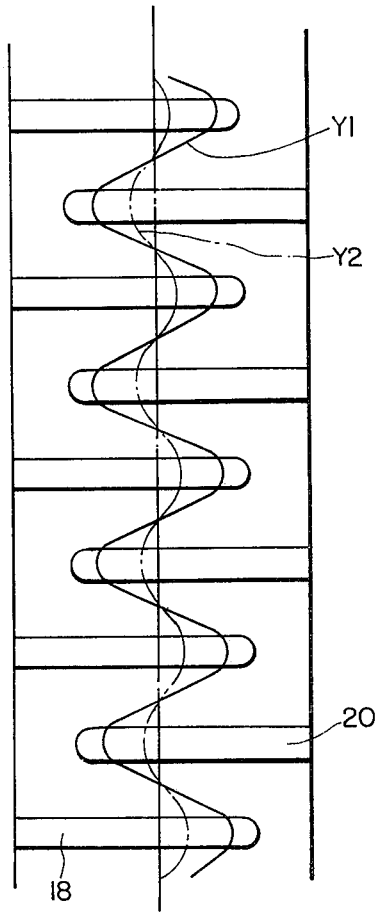
FIG. 7 is a diagram illustrating influences of the intersecting angle ($\theta$) of the pieces on the meandering distance of the yarn.

Since $\theta_2$ is larger than $\theta_1$ ($0° < \theta_1, \theta_2 < 90°$), $T_1$ is larger than $T_{1'}$. Accordingly, as the intersecting angle is small, the yarn is likely to slip down on the guide face, and therefore, the meandering distance of the yarn between the pieces is large and the yarn holding force in the feed roller is large (Y1 in FIG. 7). On the other hand, if the intersecting angle ($\theta$) between the guide faces 18*a* and 20*a* is large, the meandering distance of the yarn is small (Y2 in FIG. 7), and in the vicinity of the intersecting point, the yarn runs substantially in a line. Accordingly, the yarn holding force is small and slips are often caused in the advancing direction of the yarn. Therefore, there is a possibility of propagation of the yarn tension caused by ballooning to the side of the winding drum. Accordingly, a large intersecting angle is not preferred for obtaining a soft wound package.

The number (N) of the pieces 18 and 20 projected on the feed roller will now be described.

Figure 9:
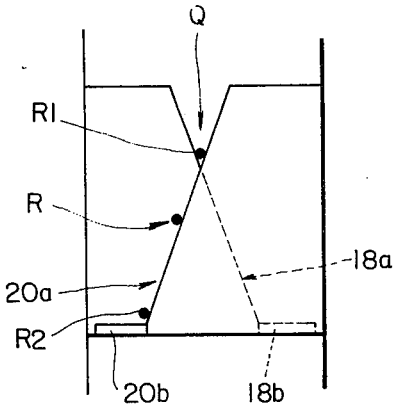
FIG. 9 is a diagram illustrating the intrusion quantity of the yarn in FIGS. 8*a* to 8*c*.

In the case where the intersecting angle ($\theta$) between yarn guide faces of confronting pieces is kept constant, when the number of the pieces 18 and 20 is large, as shown in FIG. 8*a*, the spacing (l1) between the pieces 18 and 20 in the circumferential direction is small and therefore, the yarn placed at the intersecting portion (Q) is not allowed to intrude deeply into the lower part of the guide face even by the tension and the yarn holding force is very small. In contrast, if the number of the pieces is small and the distance between the pieces is large (see FIG. 8*b*), the yarn is allowed to fall down to the bottom of the piece, but since the meandering pitch is large and the area of contact with the piece is small, the yarn holding force is weak. Accordingly, when the yarn hung on the feed roller is pulled by a hand, the yarn is likely to slip on the circumference along the guide face of the piece. Thus, it is preferred that the points of contact of the meandering yarn with the guide faces 18*a* and 20*a* of the pieces be located in an intermediate portion (R) between the intersecting portion (Q) of the guide faces 18*a* and 20*a* and the bottoms 18*b* and 20*b* of the pieces, as shown in FIG. 9. More specifically, the meandering angle is small at the point R1 and the yarn holding force is small, and although the meandering angle is large at the point R2, the holding force is weak. Therefore, if the contact point resides at R1 or R2, rising of the yarn on the delivery side of the feed roller is hardly caused and there is a risk of winding of the yarn on the feed roller. In order to obtain a good holding force eliminating the foregoing defects and not causing slips in the advancing direction of the yarn, it is most preferred that the above-mentioned contact point be set in the vicinity of the point R on the guide faces 18*a* and 20*a*. Accordingly, it is necessary to adjust the number of the pieces 18 and 20 so that an optimum piece distance (l2) as shown in FIG. 8*c* is produced.

There is established a mutual relation between the intersecting angle ($\theta$) between the pieces 18 and 20 and the number (N) of the pieces 18 and 20, both of which are important elements for reducing the yarn tension on the winding side to a level close to zero. As pointed out hereinbefore, when the intersecting angle ($\theta$) is large, since the yarn-intruding force is small, the meandering distance is small and the yarn holding force is weak. In this case, if the number of the pieces is reduced to increase the piece distance, the meandering angle is increased and the holding force is elevated to a certain level. However, the risk of slippage of the yarn is increased by reduction of the number of the pieces. When the number of the pieces is large and the intrusion quantity of the yarn is small, the intrusion quantity can be increased by decreasing the intersecting angle of the pieces and as the result, a certain holding force can be obtained. Therefore, if the number (N) of the pieces and the intersecting angle ($\theta$) of the pieces are apropriately set within the abovementioned ranges while adjusting the surface roughness (S) of the piece to 1.5$\mu$ to 6$\mu$, it is possible to reduce the yarn tension on the winding side to a level close to zero.

As the third element for obtaining a good yarn holding force, the surface roughness (S) of the guide pieces 18*a* and 20*a* of the pieces with which the yarn falls into contact can be mentioned, though this element is an auxiliary element. If the guide faces are as smooth as the mirror surface, the adhesion between the yarn and the guide face is increased and the yarn is not easily separated from the guide face and the risk of winding of the yarn on the feed roller is increased. With increase of the surface roughness of the guide face, the friction resistance between the yarn surface and the guide face is decreased. However, it is considered that the surface roughness of the guide face is excessively increased, the yarn surface will be damaged.

Figure 10:
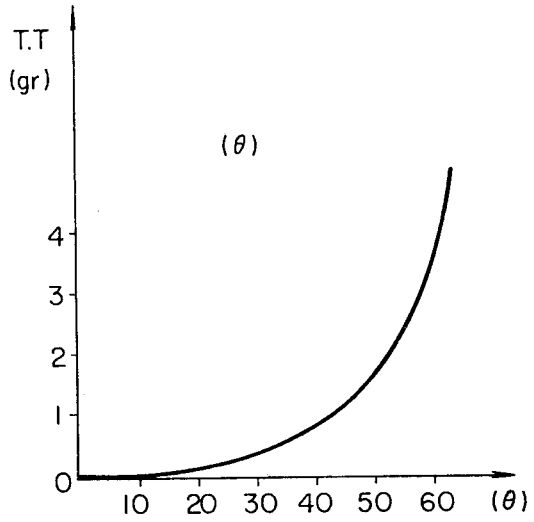
FIG. 10 is a curve showing influences of the intersecting angle ($\theta$) of the pieces on the yarn tension on the winding side.

Experiments were made on the above-mentioned elements having important influences on the tension on the winding side. In the feed roller device shown in FIG. 3, if the intersecting angle ($\theta$) between the confronting pieces 18 and 20 was changed while keeping other conditions constant, the tendency shown in FIG. 10 was observed. More specifically, if the intersecting angle ($\theta$) is larger than 40°, the winding tension (T·T) is not sufficiently reduced but is maintained at a level exceeding 1 g. It is considered that the reason is that if the intersecting angle ($\theta$) is large, the meandering distance of the yarn is small and the yarn holding force is not sufficient, as illustrated hereinbefore with reference to FIGS. 5 and 7. If the intersecting angle ($\theta$) is small, for example, less than 20° as shown in FIG. 9, the winding tension is reduced to a level close to zero. However, because of limitations of the shape, the yarn is let to fall down into the interior of the piece and the yarn is not allowed to rise on the delivery side of the feed roller. Accordingly, the risk of winding of the yarn on the feed roller 4 is increased. Accordingly, in the present invention, it is preferred that the intersecting angle ($\theta$) be adjusted to 20° to 30°.

Figure 11:
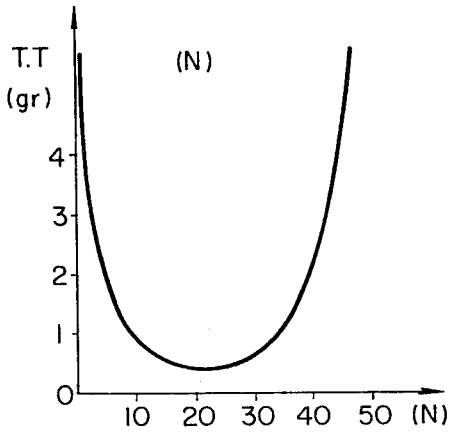
FIG. 11 is a curve showing influences of the number of the pieces on the yarn tension on the winding side.

FIG. 11 illustrates the change of the winding tension observed when the number of the pieces 18 and 20 is changed. More specifically, the total number (N) of the pieces projected on the discs 17 and 19 is changed to 10, 20, . . . while keeping the intersecting angle and other conditions constant. It is seen that when the number of the pieces 18 and 20 is too small (less than 10) or too large (more than 30), the winding tension (T·T) is not reduced, but if the number of the pieces is adjusted within the range of 10 to 30, the winding tension is reduced below 1 g. Since the meandering angle of the yarn is changed according to the number of the pieces 18 and 20, as illustrated hereinbefore with reference to FIG. 9, when the yarn falls in contact with the guide faces 18*a* and 20*a* in the intermediate portion between the intersecting point (Q) of the guide pieces 18*a* and 20*a* and the bottoms 18*b* and 20*b* of the pieces and the yarn meanders in this state, a desirable winding tension is obtained. Accordingly, in the present invention, it is stipulated that the number (N) of the pieces should be maintained within the range of $12<N<30$.

Figure 12:
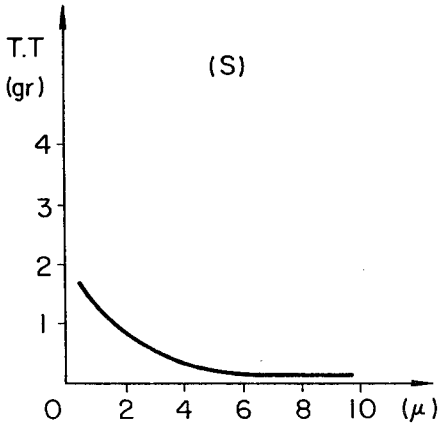
FIG. 12 is a curve showing influences on the surface roughness of the yarn guide faces of the pieces on the yarn tension on the winding side.

The change of the winding tension observed when the surface hardness (S) of the yarn guide faces 18*a* and 20*a* of the pieces 18 and 20 is changed is illustrated in FIG. 12. Other conditions are kept constant. As is seen from FIG. 12, if the surface roughness of the abrasion-resistant material of the pieces is not more than 1.5$\mu$, the winding tension is not sufficiently reduced and if the surface roughness is more than 1.5$\mu$ and up to 6$\mu$, the winding tension is reduced below 1 g. If the surface roughness exceeds 6$\mu$, the yarn surface is readily damaged though the winding tension is reduced. Accordingly, in the present invention, it is stipulated that the surface roughness (S) of the pieces should be maintained within the range of $1.5\mu<S\leqq 6\mu$.

Figure 13:
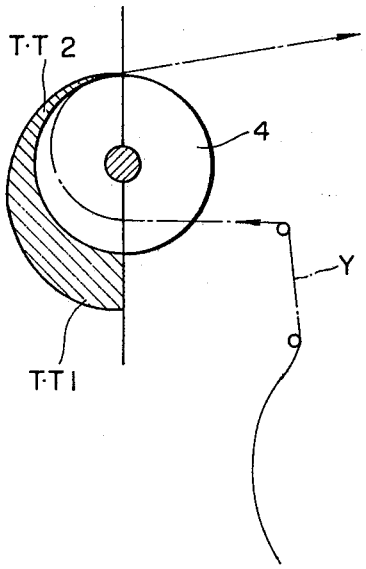
FIG. 13 is a diagram illustrating the change of the yarn tension in the feed roller.
Figure 15:
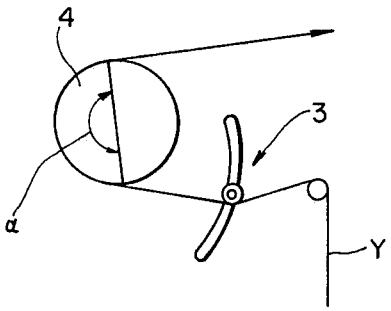
FIG. 15 is a diagram illustrating the angle of winding the yarn onto the feed roller.

The distribution of the tension on the yarn fed out by the feed roller having the above-mentioned structure is as illustrated in FIG. 13.

On the introduction side of feed roller 4, the yarn tension ($T\cdot T_1$) is increased by ballooning caused by the double twister, and therefore, the yarn deeply intrudes between the pieces of the feed roller and the force of holding the yarn by the pieces is high. On the delivery side of the feed roller, close to the winding machine, the yarn gradually rises up so that it separates from the center of the rotation shaft of the feed roller and the yarn holding force is gradually weakened, and the winding tension ($T\cdot T_2$) is reduced to a level close to zero.

The method of the present invention is practized by using the feed roller in which the above-mentioned three elements are improved. The following should be taken into account when the method of the present invention is actually practised.

Since the yarn coming from the feed roller 4 is wound while it is being traversed to the left and right by the traverse device 5, the distance between the point near each of the ends of the package and the yarn-separating point in the feed roller 4 is longer than the distance between the center of the package and the yarn-separating point in the feed roller 4, and therefore, a certain change of the tension is brought about. In the present invention, the yarn is slightly slackened so as to compensate this change of the yarn tension owing to the above difference of the distance, and the yarn speed on the delivery side of the feed roller is made substantially equal to the yarn speed on the introduction side of the feed roller. By this arrangement, a reduced yarn tension can be effectively maintained in the method of the present invention.

Figure 14:
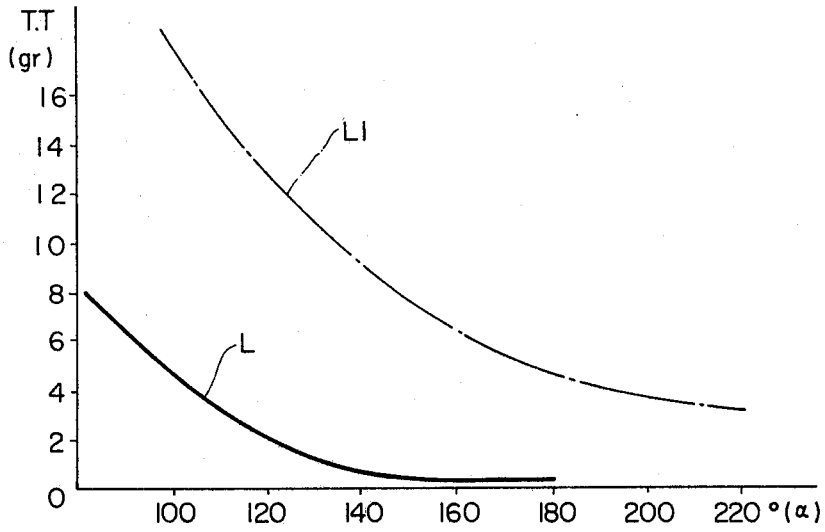
FIG. 14 shows a curve illustrating influences of the winding angle ($\alpha$) on the yarn tension on the winding side in the winding method of the present invention and a curve illustrating influences of the winding angle ($\alpha$) on the yarn tension on the winding side in the conventional winding method.

FIG. 14 illustrates the change of the winding tension observed when the conventional feed roller is operated by using a known winding angle-adjusting device and the change of the winding tension observed when the feed roller of the present invention is operated by using the same adjusting device. More specifically, in FIG. 14, the curve L1 shows the change of the tension observed when the conventional feed roller is used and the curve L shows the change of the tension observed when the feed roller of the present invention is used. In case of a polyester yarn of 150 d/2, in the conventional double twister, the winding tension cannot be reduced below about 3 g however increased the winding angle may be. On the hand, according to the present invention, if the winding angle ($\alpha$) is larger than about 130°, a winding tension can be reduced below 1 g, and if the winding angle is larger than 150°, the winding tension can be reduced to a level close to zero. Of course, this winding angle is appropriately adjusted depending on the kind of the yarn, the fineness of the yarn and other factors.

As will be apparent from the foregoing illustration, according to the present invention, by arranging between the double twister and the winding package a feed roller 14 in which the intersecting angle ($\theta$) between the confronting pieces 18 and 20 is up to 40°, ($\theta \leqq 40°$), the number (N) of pieces is adjusted within the range of $12 < N < 30$ and the surface roughness (S) of the yarn guide faces of pieces is adjusted within the range of $1.5\mu < S \leqq 6\mu$ and also by slightly slackening the yarn between the feed roller and the take-up roller and satisfying the above-mentioned yarn speed condition, the winding tension can be reduced below 1 g and a soft wound package having a wind density ($\rho$) in the range of 0.1 g/cm$^3 \leqq \rho \leqq$ 0.2 g/cm$^3$ suitable for dyeing can be obtained directly from the double twisting spindle, though such soft wound package cannot be directly obtained from the double twisting spindle according to the conventional technique. Accordingly, the rewinding step for formation of a soft package for dyening can be omitted.

An example of the method of the present invention will now be described.

By using a double twisting spindle for processed yarns, which rotates at a rotation number of 6200 rpm and provides a twist number of 84 twists per meter, a polyester processed two folded yarn of 150 d is wound so that the wind width is 200 mm and the wind diameter is 277 mm (the empty bobbin diameter being 88 mm). In the feed roller used, the intersecting angle ($\theta$) of the confronting pieces of the feed roller is adjusted to 20°, the number (N) of the pieces is 24 and the surface roughness (S) of the guide faces of the pieces of the feed roller is adjusted to 3$\mu$. The yarn is slightly slackened between the feed roller and the take-up roller and the yarn speed on the delivery side of the feed roller is made substantially equal to the yarn speed on the introduction side of the feed roller. By adjusting the angle of winding of the yarn on the feed roller by using a known adjusting device, the yarn tension (T·T) is reduced below 1 g. The amount of the yarn on the fully wound package is 1560 g. Accordingly, the wind density ($\rho$) is 0.144 g/cm$^3$ in the resulting wound package. Thus, it is confirmed that the obtained package is a soft wound package suitable for dyeing.

What is claimed is:

1. An apparatus for twisting and winding yarns on packages including a double twisting spindle, a feed roller for reducing the tension of yarn coming from the double twisting spindle, an adjustable winding angle-adjusting device which is arranged between the double twisting spindle and the feed roller to set a yarn to be wound on the feed roller at a predetermined winding angle, a traverse device and a take up roller for winding the yarn on a package, wherein said feed roller comprises a first disc formed on a feed roller proper fixed to a driving shaft, a second disc disposed to confronting the first disc, a plurality of pieces having an inclined yarn guide face projected equidistantly in the circumferential direction on an end face of the discs respectively, said guide faces of the pieces being arranged to be confronting and mutually interposing between the two discs, and a spacer inserted under the pieces and disposed between the discs for adjusting the distance between the pieces.

2. An apparatus for twisting and winding yarns on packages as claimed in claim 1, wherein said adjustable winding angle-adjusting device comprises a bracket having a long groove stationarily set at a position close to the feed roller, a stationary roller fixed to the bracket, a moving roller, a moving cylinder, a moving roller supporting cylinder, said cylinders being arranged on both the sides of the long groove to confront each other with the bracket and being integrally connected to each other by a clamping screw piercing through the long groove, a spring interposed between the moving cylinder and the clamping screw to movably press the moving cylinder and roller supporting cylinder to both the side portions of the bracket, and a stationary roller fixed on the bracket, said moving roller and stationary roller being arranged so that they are located just below the yarn passage of the feed roller.

3. An apparatus for twisting and winding yarns on packages as claimed in claim 1, wherein the number (N) of said pieces of the feed roller is in the range of $12 < N < 30$, an intersecting angle ($\theta$) between the confronting yarn guide faces of the pieces is up to 40°, and the surface roughness (S) of the yarn guide faces is in the range of $1.5\mu < S \leqq 6\mu$.

4. A method for obtaining packages for dyeing by twisting and winding processed yarn by an apparatus having a double twisting spindle, a feed roller, a winding angle-adjusting device, a take-out roller and a traverse device, said method including the step of operating the respective members of the apparatus so that a yarn is slackened between the feed roller and the take-up roller and the yarn speed on the delivery side of the feed roller is substantially equal to the yarn speed on the introduction side of the takeup roller, whereby the yarn is wound up while maintaining the yarn tension between the feed roller and the take-up roller below 1 g and the wind density (p) of the resulting package is controlled within the range of 0.1 g/cm$^3 \leqq \rho \leqq$ 0.2 g/cm$^3$.

5. An apparatus for twisting and winding yarns on packages including a double twisting spindle, a feed roller for reducing the tension of a yarn coming from the double twisting spindle, an adjustable winding angleadjusting device which is arranged between the double twisting spindle and the feed roller to set a yarn to be wound on the feed roller at a predetermined winding angle comprising a bracket having a long groove stationarily set at a position close to the feed roller, a stationary roller fixed to the bracket, a moving roller, a moving cylinder, a moving roller supporting cylinder, said cylinders being arranged on both the sides of the long groove to confront each other with the bracket and being integrally connected to each other by a clamping screw piercing through the long groove, a spring interposed between the moving cylinder and the clamping screw to movably press the moving cylinder and roller supporting cylinder to both the side portions of the bracket, and a stationary roller fixed on the bracket, said moving roller and stationary roller being arranged so that they are located just below the yarn passage of the feed roller, a traverse device and a take-up roller for winding the yarn on a package.

6. A method for obtaining packages for dyeing by twisting and winding processed yarn by an apparatus having a double twisting spindle, a feed roller, a winding angle adjusting device, a take-out roller and a traverse device, said method including the steps of passing yarn from the double twisting spindle over a stationary roller guide passing the yarn over an adjustable winding angle roller positioning the adjustable winding angle roller to set a yarn to be wound on the feed roller at a predetermined winding angle passing the yarn over the feed roller to the traverse device and subsequently onto a take-up roller whereby the yarn is wound up while maintaining the yarn tension between the feed roller and the take-up roller at a predetermined low level.

* * * * *